US006974951B1

(12) United States Patent
Kingston

(10) Patent No.: US 6,974,951 B1
(45) **Date of Patent: *Dec. 13, 2005**

(54) AUTOMATED IN-PROCESS RATIO MASS SPECTROMETRY

(75) Inventor: Howard M. Kingston, Pittsburgh, PA (US)

(73) Assignee: Metara, Inc., Sunnyvale, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/004,627

(22) Filed: Dec. 4, 2001

Related U.S. Application Data

(60) Provisional application No. 60/264,748, filed on Jan. 29, 2001.

(51) Int. Cl.[7] ..... H01J 49/26

(52) U.S. Cl. ..... 250/282; 250/281; 250/288

(58) Field of Search ..... 250/281–288; 204/1 T, 153.1; 436/173; 73/23.25

(56) References Cited

U.S. PATENT DOCUMENTS

| | | | | |
|---|---|---|---|---|
| 4,132,605 A | | 1/1979 | Tench et al. | |
| 4,324,621 A | | 4/1982 | Kerby | |
| 4,479,852 A | | 10/1984 | Bindra et al. | |
| 4,917,777 A | | 4/1990 | Fisher | |
| 4,975,328 A | | 12/1990 | Hirose et al. | |
| 5,012,052 A | | 4/1991 | Hayes | |
| 5,182,131 A | | 1/1993 | Hashimoto et al. | |
| 5,192,403 A | | 3/1993 | Chang et al. | |
| 5,352,893 A | * | 10/1994 | Freedman | 250/281 |
| 5,414,259 A | | 5/1995 | Kingston | |
| 5,572,024 A | | 11/1996 | Gray et al. | |
| 5,696,378 A | | 12/1997 | Busch et al. | |
| 5,703,360 A | | 12/1997 | Fischer et al. | |
| 5,872,357 A | | 2/1999 | Flanagan | |
| 6,032,513 A | | 3/2000 | Chorush et al. | |
| 6,280,602 B1 | | 8/2001 | Robertson | |
| 6,486,469 B1 | * | 11/2002 | Fischer et al. | 250/288 |

FOREIGN PATENT DOCUMENTS

| | | | | |
|---|---|---|---|---|
| WO | WO 99/39198 | * | 8/1999 | 250/281 |

OTHER PUBLICATIONS

Fassett et al., *Determination of Nanogram Quantities of Vanadium in Biological Material by Isotope Dilution Thermal Ionization Mass Spectrometry with Ion Counting Detection*, Anal. Chem. (Nov. 1985), pp. 2474–2478, V57, No. 13.

Fassett et al., *Isotope Dilution Mass Spectrometry for Accurate Elemental Analysis*, Anal. Chem. (May 15, 1989), pp. 643A–649A V61, No. 10.

Viezian et al., *On–line Isotope Dilution and Sample Dilution by Flow Injection and Inductively Coupled Plasma Mass Spectrometry*, J. Anal. Atom. Spectro. (Apr. 1990), pp. 125–133, V5.

(Continued)

*Primary Examiner*—Bruce Anderson
*Assistant Examiner*—James P. Hughes
(74) *Attorney, Agent, or Firm*—Jonathan W. Hallman; MacPherson Kwok Chen & Heid LLP

(57) ABSTRACT

A method and associated apparatus for in-process automated analysis employing a mass spectrometry ratio measurements is disclosed. It involves elemental and speciation threshold measurement that is optimized for quality assurance at and is capable of functioning at and near quantitative instrumental detection limits. The system is automated and may be employed in an unattended operation for identification and quantification of elemental or specie contaminants. In a preferred aspect of the method, a sample is subjected to equilibration with at least one spike after which it is subjected to ionization in an atmospheric ion generator and processed by a mass spectrometer with the output of the mass spectrometer being processed by a microprocessor which through a controller coordinates operation of sample and spike delivery and equilibration as well as the operation of the atmospheric ion generator and mass spectrometer. The method may in the alternative be employed qualitatively.

37 Claims, 8 Drawing Sheets

OTHER PUBLICATIONS

Rottmann et al., *Determination of Heavy Metal Interactions with Dissolved Organic Materials in Natural Aquatic Systems by Coupling a High–Performance Liquid Chromatography System with an Inductively Coupled Mass Spectrometer*, Anal. Chem. (Nov. 1, 1994), pp. 3709–3715, V66.

Heumann et al., *Elemental Speciation with Liquid Chromatography–Inductively Coupled Plasma Isotope Dilution Mass Spectrometry*, J. Anal. Atom. Spectro. (Dec. 1994), pp. 1351–1355 V9.

Horn et al., *Comparison of heavy metal analyses in hydrofluoric acid used in microelectronic industry by ICP–MS and thermal ionization isotope dilution mass spectrometry*, Fresenius J. Anal. Chem (1994), pp. 286–292, V350.

Rottmann et al., *Development of an on–line isotope dilution technique with HPLC/ICP–MS for the accurate determination of elemental species*, Fresenius J. Anal Chem. (1994), pp. 221–227, V350.

Cole, *Electrospray Ionization Mass Spectrometry: Fundamentals, Instrumentation and Applications*, John Wiley & Sons, Inc. (1997), New York.

Stewart, *Electrospray mass spectrometry: a tool for elemental speciation, Spectrochimica*, Acta. (1999), pp. 1649–1695, Part–B, vol. 54.

*International Technology Roadmap for Semiconductors 1999 Edition: Defect Reduction*, Sematech, Austin, TX, pp. 269–293.

Newton et al., *Analysis of Copper Planting Baths—Suppressors and Levelers*, Electrochemical Society Proceedings, pp. 1–5, V2000–27.

Applications of Isotope Dilution–Mass Spectrometry in Clinical Chemistry, Pharmacokinetics and Toxicology, Mass Spectrometry Reviews, pp 249–307 (1992).

* cited by examiner

AUTOMATED IN-PROCESS RATIO MASS SPECTROMETRY

CROSS REFERENCE TO RELATED APPLICATION

This application claims the benefit of U.S. Provisional Application Ser. No. 60/264,748, filed Jan. 29, 2001.

BACKGROUND OF THE INVENTION

1. Field of the Invention

This invention relates to a method and apparatus for an in-process, automated analysis using a ratio measurement. More specifically, the disclosed In-process, Atmospheric Pressure Interface, Mass Spectrometer (IP-API-MS) apparatus and related method uses a ratio measurement to characterize the amounts or concentrations of analytes. This characterization may be optimized for quality assurance at and near instrumental detection limits.

2. Description of the Prior Art

Mass spectrometry instrumentation is frequently used as the technique of choice in measuring parts-per-billion (ppb) and sub-ppb levels of elements or compounds in aqueous and other solutions as well as in gases. Mass spectrometers are typically operated and regularly calibrated by experienced technicians. In many cases, however, unattended operation of the mass spectrometer is desired. These cases may include remote operation, around the clock monitoring, or operation either in hostile environments, or where human interaction must be minimized. One such case is that of contamination monitoring and control in the wet process baths, such as, for example, the semiconductor industry which requires a clean room environment where minimal human interaction is desired. Installation of real time, in-situ, sensors into clean room process is a major defect reduction challenge in the industry. *International Technology Roadmap for semiconductors* 1999 Edition: Defect Reduction, Sematech, Austin Tex., (pg. 270) (1999).

In order to accomplish unattended operation, the method should automatically monitor elemental concentrations at their threshold level, accurately and without the need to compensate for the inevitable systematic errors associated with instrument drift. Quantitation of elemental concentrations may then be obtained without the need for traditional calibration once the threshold level has been exceeded. Traditional calibration techniques use calibration standards to generate a calibration curve which relates instrument response to concentration of standards. The calibration curve is used in order to determine the concentration of unknown sample. A typical calibration curve is illustrated in FIG. 1 (curve A). Traditional techniques will not yield accurate results if the instrument response drifts or there is a response shift caused by a difference in the matrices between the standard and the sample. Mass spectrometers are especially susceptible to rapid drift causing a change in the calibration response as shown in FIG. 1 (curve B). This rapid drift results in the need for frequent recalibrations that are normally performed by experienced technicians. The effort of matching the matrices of the sample and standard must be made in order to insure ionization efficiencies, ionization suppression or enhancements remain identical between sample and standard.

Viscosity differences between the sample and standard matrices may also cause unequal instrument responses associated with changing sample introduction rates which are inevitable in real world situations. Matrix effects altering solution viscosity or ionization efficiency can result in calibration changes such as shown in FIG. 1 (curve C).

IDMS is based upon the addition of an enriched isotope standard to a sample to be analyzed. See, generally, U.S. Pat. No. 5,414,259 the disclosure of which is expressly incorporated herein by reference. After equilibration of the sample and standard, the natural isotopic ratio of the sample will have been altered by the enriched standard and the new isotopic ratio is measured by a mass spectrometer. If the concentration of an enriched isotopic standard is known, as well as the enriched isotopic ratio, then the measured ratio of altered natural elemental isotopes provides the elemental concentration of the sample. This method has only a very few well-defined possibilities for error. Each of these possibilities can be calibrated and eliminated, leaving the uncertainty in ratio determination of the two isotopes as the final error for the measurement. This uncertainty is based on the mass spectrometer's ability to make this isotopic ratio measurement. If the enriched isotope standard of known concentration is introduced, in a precisely controlled fashion, to the sample on-line, all normal interferences are eliminated for each element or species being measured. As only the altered isotope ratio is needed to obtain the concentration of the sample, the physical and chemical differences of flow rate and ionization efficiencies are essentially eliminated. Therefore, IDMS is an ultimate correction technique for both long-term and short-term instrument drift, as well as countering non-spectroscopic interference. This procedure, in general, provides accurate detection for the instrument and process necessary for quality control in ultra-trace analysis. In addition, traditional IDMS has been employed primarily with both Inductively Coupled Plasma Mass Spectrometers (ICP-MS) and Thermal Ionization Mass Spectrometers (TIMS). Both ICP-MS and TIMS instrumentation are not deemed suitable for operation in an unattended mode. Fassett, J. D., Paulsen, P. J. Isotope-dilution mass spectrometry for accurate elemental analysis, *Anal. Chem.* (1989) 61 643A–649A; Rottmann, L., Heumann, K. G., Development of an on-line Isotope Dilution Technique with HPLC/ICP-MS for the accurate determination of elemental species. *Fresenius J. Anal. Chem.*, (1994) 350 221–227; Rottmann, L., Heumann, K. G., Determination of Heavy Metal Interactions with Dissolved Organic Materials in Natural Aquatic Systems by Coupling High-Performance Liquid Chromatography System with an Inductively Coupled Plasma Mass Spectrometer. *Anal. Chem.*, (1994) 66, 3709–3715; Heumann, K. G., Rottmann, L., Vogl, J., Elemental Speciation with Liquid Chromatography-Inductively Coupled Plasma Isotope Dilution Mass Spectrometry. *J. Anal. Atom. Spectro.* (1994) 9 1351–1355; Horn, M., Heumann, K. G., Comparison of Heavy Metal Analysis in Hydrofluoric Acid used in Microelectronic Industry by ICP-MS and Thermal Ionization Isotope Dilution Mass Spectrometry, *Fresenius J. Anal. Chem.*, (1994) 350 286–292.

A method of using on-line IDMS as an internal standard with an ICP-MS instrument has been suggested with an enriched isotopic standard being continuously introduced into the sample stream and mixed (allowed to equilibrate) prior to introduction into an ICP-MS instrument. Rottmann, L., Heumann, K. G., Development of an on-line Isotope Dilution Technique with HPLC/ICP-MS for the accurate determination of elemental species. *Fresenius J. Anal. Chem.*, (1994) 350 221–227; Rottmann, L., Heumann, K. G., Determination of Heavy Metal Interactions with Dissolved Organic Materials in Natural Aquatic Systems by Coupling High-Performance Liquid Chromatography System with an Inductively Coupled Plasma Mass Spectrometer. *Anal. Chem.*, (1994) 66, 3709–3715; Heumann, K. G., Rottmann, L., Vogl, J., Elemental Speciation with Liquid Chromatography-Inductively Coupled Plasma Isotope Dilution Mass Spectrometry. *J. Anal. Atom. Spectro.* (1994) 9 1351–1355. An on-line HPLC/ICP-IDMS method for elemental speciation was tested. In the case published, heavy metals in humic complexes found in natural waters were measured using a High Resolution ICP-MS with either an iron, copper, or a molybdenum enriched spike introduced as the IDMS calibration standard. Selection of which element standard was contingent upon the element to be analyzed in the sample. Rottmann, L., Heumann, K. G., Development of an on-line Isotope Dilution Technique with HPLC/ICP-MS for the accurate determination of elemental species. *Fresenius J. Anal. Chem.*, (1994) 350 221–227; Rottmann, L., Heumann, K. G., Determination of Heavy Metal Interactions with Dissolved Organic Materials in Natural Aquatic Systems by Coupling High-Performance Liquid Chromatography System with an Inductively Coupled Plasma Mass Spectrometer. *Anal. Chem.*, (1994) 66, 3709–3715; Heumann, K. G., Rottmann, L., Vogl, J., Elemental Speciation with Liquid Chromatography-Inductively Coupled Plasma Isotope Dilution Mass Spectrometry. *J. Anal. Atom. Spectro.* (1994) 9 1351–1355. It was stated that "quantitative chromatographic separation of the species to be analyzed" is one of the preconditions for this method and "quantitative separation is essential before the spiking step takes place (for a species-unspecific spike)." It was also stated that "(for a species-unspecific spike), equilibration between the separated species and spike must be guaranteed . . . by high temperature of the argon plasma (in ICP-MS)." Rottmann, L., Heumann, K. G., Development of an on-line Isotope Dilution Technique with HPLC/ICP-MS for the accurate determination of elemental species. *Fresenius J. Anal. Chem.*, (1994) 350 221–227. HPLC separation and ICP-MS measurement are two essential parts of their method.

Semiconductor manufacturers rely on the purity of chemicals to create sub-micron devices from silicon wafers. Impure chemicals tend to result in devices that will not work. It is, therefore, important to know whether a wet chemical is, in fact, pure, or adequately pure. Current methods of determining purity tend to be expensive, slow, off-line chemical analyzers. This problem becomes enhanced with continued device shrinkage as in the move to 300-mm wafers and copper interconnects. Captive and contract analytical laboratories tend to produce chemical assays and time frames ranging from 24 to 72 hours. One of the consequences of this lack of timely information is the failure to know when to dispose of these expensive chemicals.

It has been suggested to employ in-line ICP-MS in a method of monitoring concentration of metals in silicon wafer cleaning baths. See Using ICP-MS for in-line monitoring of metallics in silicon wafer cleaning baths.

Isotope dilution Mass Spectrometry for ultra-trace analysis has been previously known. Fassett, J. D. and Kingston, H. M., Determination of Nanogram Quantities of Vanadium in Biological Material by Isotope Dilution Thermal Ionization Mass Spectrometry With Ion Counting Detection, *Anal. Chem.*, (1985) 57 2474–2478. In this publication ultra-trace analysis uses IDMS in the traditional way with isotopically enriched spikes in batch spiked standards. These isotopes are spiked into low concentration samples and blanks and any species information is removed using the batch sample method. Complete transformation of all species is traditionally a prerequisite to most IDMS protocols to prevent multiple species existing in the sample simultaneously. In addition, this transformation prevents the spiked isotopes and the sample isotopes from existing in different species form. As a result, elemental species determinations and evaluations providing both are not possible and are in fact prevented by the traditional IDMS technique.

U.S. Pat. No. 5,012,052 discloses a patent by Hayes describes a method for isotope monitoring for gas that is an on-line continuous combustion from organic components to assist in the determination of the origin of objects based on the C-12 and C-14 ratios. This method requires a combination of gas chromatograph and flame ionization detector (FID), and palladium separator and oxygen charged combustion reactor prior to mass spectrometry. The method requires the use of the combustion chamber, and a palladium separator prior to the mass spectrometer. The goal of this method and instrument is comparison with an isotopic standard to establish isotopic ratios for carbon for origin identification of gases specifically using C-12 and C-14. There is no attempt to perform trace analysis of transition or other metals and quantification is not based on isotope dilution measurements. This method will not work for metals.

U.S. Pat. No. 5,572,024 discloses method and apparatus for quieting the introduction into a mass spectrometer from inductively coupled plasma (ICP) devise by manipulating skimmer cone diameters and pressure. The invention is an improvement of ratio precision measurements over well known ICP-MS and MIP-MS (microwave induced plasma) technology. It describes modifications to a mass spectrometer inlet that enables more precise measurement of isotopes. It requires a plasma device and also reduces the sensitivity of the mass spectrometer.

U.S. Pat. No. 5,872,357 discloses a series of calibrant compositions for organic compounds that enable calibration across a broad mass spectral range for electrospray mass spectrometry, as well a method of using these organic calibrant compositions to calibrate a mass spectrometer. The invention provides a class of new organically based calibrant compositions and limits its application to the usage of these calibrant compositions.

U.S. Pat. No. 6,032,513 discloses a hollow electrode for the improvement of ionization in an atmospheric-pressure ionization source and substitute a more easily ionized carrier gas for the sample gas stream. The disclosure is specific for gas analysis and requires the substitution of the gas stream and the use of a hollow electrode prior to a mass spectrometric measurement. This technology is not applicable in the isotopically based measurements that are the focus of the present invention.

IDMS using Flow Injection Analysis (FIA) introduction to an ICP-MS has been known. Viezian, Miklos; Alexandra Lasztity, Zioaru Wang and Ramon M. Barnes, On-Line Isotope Dilution and Sample Dilution by Flow Injection and Inductively Coupled Plasma Mass Spectrometry, *J. Anal. Atom. Spectro.*, (1990) 5 125–133. This technique uses FIA to mix the isotopically enriched spike and the sample prior to introduction to the ICP-MS. The spike and sample are injected simultaneously to form a zone within a neutral carrier liquid prior to introduction to the ICP-MS. The volume of a fixed sample loop controls the amounts of spike and sample. Physical mixing of the two solutions occurs between the confluence point and the nebulizer. As in traditional IDMS methods species information is unavailable, as the enriched spike is species-unspecific. In addition, the technique suggested on-line dilution using an inert reagent; a technique that is easily accomplished using FIA.

An automated calibrant apparatus was disclosed in U.S. Pat. No. 5,703,360. It introduces a standard reference solution automatically into a mass spectrometer ESI or Atmospheric Pressure Chemical Ionization (APCI) to calibrate or tune the mass spectrometer. In this patent a switching valve is used to introduce the standard as desired to the ESI or APCI. As the standard reference solution and the sample solution are from different sources matrix effects are not eliminated.

U.S. Pat. No. 5,703,360 discloses that one or two traditional standard reference solutions can be used to tune the mass spectrometer with respect to the mass axis, and to assess the functionality of the instrument and to re-calibration the instrument. This technique of introducing two sequential calibration standards will not eliminate the short or long-term drift that can be a problem in unattended operation of a mass spectrometers. See U.S. Pat. No. 5,703,360.

Atmosphere pressure ionization (API) techniques includes electrospray (ES) ionization and atmosphere pressure chemical ionization (APCI). This technique has been widely used to characterize bio-molecules such as peptides, proteins, nucleic acids and carbohydrates. Cole, R. B. Electrospray Ionization Mass Spectrometry: Fundamentals Instrumentation & Applications; John Wiley & Sons, Inc.: New York, 1997. It is also used to qualitatively determine the presence of inorganic, organometallic and complexed metal ions, but quantifying that information has remained a significant challenge. High background due to chemical noise and signal suppression (matrix effects) appear to be the uppermost limiting factors for the quantification of most analytes. Stewart, I. I., Electrospray Mass Spectrometry: a Tool for Elemental Speciation, Spectrochim. Acta. Part-B. (1999) 54B 1649–1695. Collision-induced dissociation (CID) generates energetic collisions and can simplify mass spectra, reduce the background and increase the sensitivity. However, stable operation is limited to a narrow range of solution conductivities and can cause inherent non-linearity signal response during the quantification.

Speciated Isotope Dilution Mass Spectrometry (SIDMS) has been developed to assess the quantification of species and also their transformations. See U.S. Pat. No. 5,414,259. In SIDMS a predetermined species is specifically isotopically labeled and introduced to accomplish these measurements. The species of interest is previously known and specifically evaluated.

In summary, a method and associated apparatus have been developed to accomplish unattended operation of an apparatus that will automatically and accurately monitor elemental concentration threshold levels, identify, and quantify elemental contaminants or compounds and species in fluids.

SUMMARY OF THE INVENTION

The present invention employs a ratio measurement analogous to that used in traditional IDMS methods. The ratio measurement allows the characterization of a sample. To obtain the ratio measurement, a spike is added to a sample. After equilibration, the spicked sample is ionized using atmospheric pressure ionization and the resulting ions introduced into a mass spectrometer to form a ratio. A processor may then use the ratio to characterize the sample.

The method and apparatus of this invention employs the relatively-mild ionization provided by an atmospheric pressure ionization process such as, for example, electrospray in contrast to the relatively-harsh ionization encountered within an ICP-MS. Because of this relatively-mild ionization process, species information such as the concentration of a particular ionization state of an element or molecular complex within a sample is preserved thereby eliminating the necessity of a physical separation step after equilibration of the spike and sample. In contrast, such species information may be lost as a species is ionized in an ICP-MS process.

In the present invention, an analyte may be characterized in a sample without requiring the provision of an isotopically-enriched spike in the same speciated form as the analyte. Instead the analyte and spike may be transformed to the same species during equilibration of the spike and sample, through for example, dynamical pre-treatment such as oxidation or simply through a reaction of the spike with the sample's matrix.

In one embodiment, the present invention relates to a method and apparatus that enhances and improves measurement at and near the detection limit of mass spectrometers. In this embodiment, the spike concentration is adjusted based upon pre-determined criteria such as an expected concentration range for the analyte to enhance characterization of an analyte using a ratio measurement.

In one embodiment of the invention, the method and apparatus enables the IP-MS to be operated in an unattended manner that is a substantial departure from attended operation protocol where operator calibration and analysis are typically performed. Direct comparison against a calibration curve is unnecessary through the use of ratio measurements. This is a departure from traditional instrument operation where concentrations of elements are made in comparison and where instrument drift requires frequent re-calibration required for quantitation. In one embodiment, the ratio of the analyte to the spike in a spiked sample is optimized for accuracy and quality assurance at and near the detection limits of the measurement.

In yet another embodiment of the invention, the method and apparatus quantifies elements without speciation information by mixing known enriched isotopes of elements in a semi-continuous process with the in-process sample stream from the chemical solutions being evaluated. The ionization voltage is purposefully set atypically high enough to eliminate species information directly at the source of the mass spectrometer to optimize the elemental quantitation.

In a further aspect of the invention, the method and apparatus mixes non-ligand bound or weakly ligand optimized enriched isotopes allowing for species transformations of the enriched isotopes into the dominant species set by the chemistry of the reagent streams being interrogated. These species are then directly evaluated using very low voltage and softer ionization conditions preserving the species information of the sample solutions using the same apparatus automatically controlled in alternate methods.

In an additional aspect of the invention, the method and apparatus uses additional solution manipulation after introduction of the stable optimized isotopes to alter the chemical species to permit optimum ionization for maximum sensitivity and detection limits. Other solution manipulations may be performed to change the matrix of the fluid to permit optimum ionization for maximum sensitivity and detection limits.

In yet another aspect of the invention, the method and apparatus mixes the optimized stable isotopes with the sample and the resulting solution is separated or preconcentrated by element and/or species for sequential evaluation, optimization and maximum sensitivity.

In a particular use, wherein contaminant levels may be monitored at the ultra-trace level in baths employed in the semiconductor industry, in the cleaning of wafers an early warning or alarm may be sounded responsive to a contamination level approaching an upper tolerable limit in the case of warning or reaching or exceeding the same in the case of an alarm.

Corresponding apparatus is provided.

DESCRIPTION OF THE PREFERRED EMBODIMENTS

Figure 1:
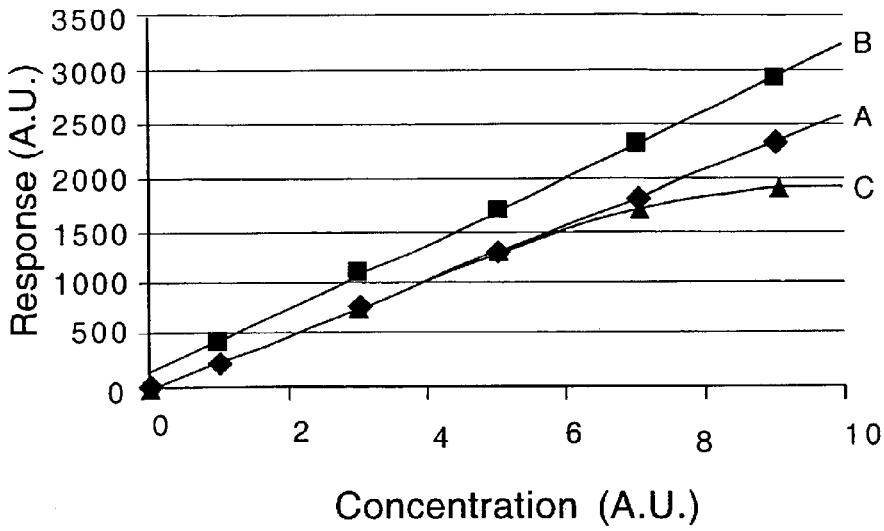
FIG. 1 (Prior Art)
FIG. 1 is a plot of response versus calibration in illustrating calibration curve drift.

The term "specie" as employed herein shall refer to elemental species, ionic species, molecular species, complex species such as organometallic species and any other species which may be adapted for qualitative and quantitative analysis using the present invention.

As used herein, the term "ratio" shall refer to an isotopic ratio of a specie and/or an element.

The term "fluid" as employed herein in respect of a mass stream containing either "specie or element" or "spike" or both in the form of, but not limited to, liquid or gas.

The term "threshold" as employed herein in respect of a level of a "specie or element" above which the "specie or element" can be determined quantitatively using present invention.

The term "quantitative detection limit of an instrument" means the lowest level of concentration of a particular element or specie which an instrument can detect quantitatively.

In this invention the isotopically enriched standard spikes added to the sample are allowed to come to species equilibrium with the isotopes in the sample prior to measurement and quantitative and species information then becomes available in the same solution. Adjustment of the enrichment mix to optimize the ratio for mathematical evaluation at the threshold detection level is not employed in traditional methods as quantitative information rather than threshold detection is the goal.

The method and apparatus are usable in in-process automated ultra-trace element, contaminant, and species analysis. This invention provides for a method and apparatus for a fluid handling in-process/mass spectrometer (IP-MS) analytical apparatus that uses optimized stable isotopic ratios for in-process automated and unattended operation. Both qualitative and quantitative analysis of ultra-trace elements and species information is available through the method and in this apparatus. The method uses a mass spectrometer interface that is an Atmospheric Pressure Ionization (API) system that allows both quantitative elemental measurement and species evaluation. The fluid handling system introduces the separated and optimized isotopes in a highly exchangeable ligand form that is dynamically transformed to the species occurring in the fluids being tested. The stable enriched isotopes are optimized for ratio measurement enabling efficient monitoring at and near the threshold of detection.

The present invention in one embodiment employs dynamic mixing of the standard enriched spike into the sample in order to eliminate undesired matrix effects.

Mass spectrometers are instruments that are not generally operated in an unattended manner for extended time periods, such as several days to a week at a time. Inherent variations in these instruments arise from changes that occur in stability in the calibration and operational conditions that substantially alter the quantitative capability. Changes in reagents and samples also affect mass flow and physical conditions of the instrument and change with time. All of these situations are normally dealt with through the manual and independent calibration and re-calibration of both the mass spectrometer and fluid handling systems. In the present invention, the method and apparatus enable the IP-MS to be operated in an unattended manner that is a substantial departure from attended operation protocol where operator calibration and analysis are typically performed. Direct comparison against a calibation curve is eliminated through the use of ratio measurements. These physical and time dependent alterations are removed through the reliance on isotopic ratios that remove the instrument stability parameters as sources of error in quantitative measurement.

Using the in-process Isotope Dilution methods of the present invention can significantly overcome the problems of signal suppression and non-linear signal response, therefore making quantification of inorganic elements and unattended operation feasible.

Figure 2:
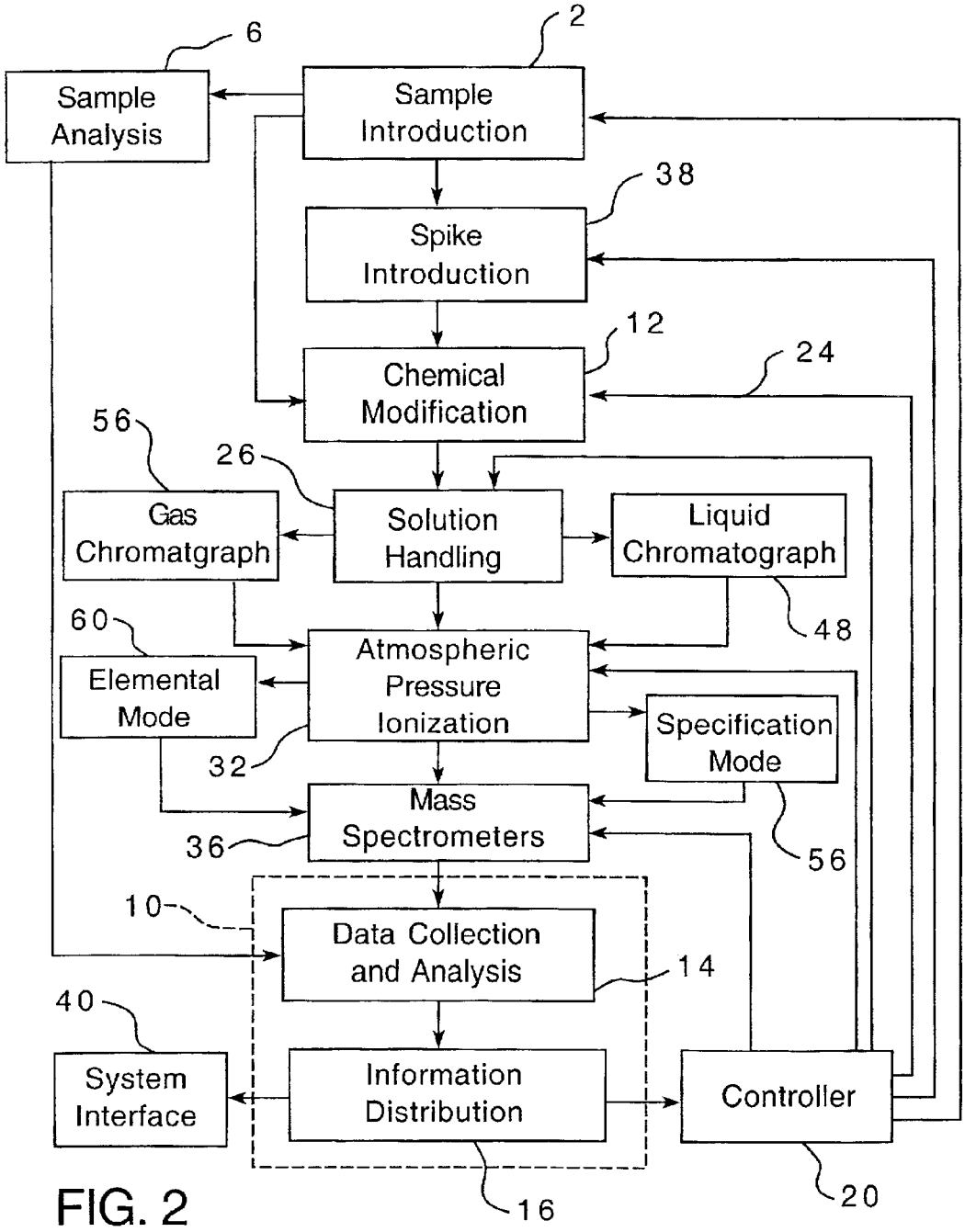
FIG. 2 is a schematic diagram illustrating a method of the present invention.

Referring now in greater detail to FIG. 2, a preferred method of the present invention will be considered. For convenience of disclosure, although reference will be made to monitoring of wet baths of the type used in clean rooms for wafer production in the semiconductor industry, it will be appreciated that the method is not so limited. The present method has the capability of performing both qualitative and quantitative analysis regarding specie and elemental contamination levels at the ultra-trace level and at the quantitative detection limit of the instrument. Traditionally, a plurality of baths, each containing aqueous or organic solvent solutions, are provided with the wafers to be cleaned being sequentially taken from one bath to the next. As a result, it becomes important to determine whether contaminants in each bath are within tolerable limits. The failure to do so can result in very expensive and time-consuming loss of product. The present invention contemplates either sequential analysis of each bath or simultaneous analysis of samples from two or more baths. It also provides a means for ascertaining on the basis of identification of the particular specie or element which specific bath is subject to contamination if contamination exists. One may also determine the origin of a contaminant based on its species composition, the component of the baths and the chemical reactions occurring therein.

Elemental Species are controlled by the chemistry of the solutions and by the processes in the specific chemistry operations that are in process. For example in the semiconductor industry where the cleaning and etching baths that are described in table 1 are present species established in these pure solutions by dominant anion complex formations such as aqueous hydrates, fluoride, chloride, arunonia, and hydroxide. The stability of these ligand complex ions and molecules will be maintained if no other ligand with a higher formation constant $K_f$ is introduced. As a result, the metal ions in the high purity solutions of 1%–10% HF aqueous solution by volume will be dominated by the fluoride ion ligand complex. In solutions of $HCl:H_2O_2:H_2O$ (1:1:6 by volume) the dominant ligand will be the chloride ligand. For example iron(III) has progressively more stable fluoride formation constant of $K_{f1}$, $K_{f2}$, and a $K_{f3}$ of $2\times10^5$, $2\times10^9$ and $4\times10^{12}$, respectively, (with a combined $K_f$ of for all three of $4\times10^{26}$) and chromium(III) $K_{f1}$ $2\times10^4$, $K_{f2}$ $6\times10^8$, and $K_{f3}$ of $2\times10^{10}$ (the combined Cr(III) for a $[CrF]_{complex}$ is $3\times10^{22}$) is. In the HCl solution Cu(I) has a $K_{f2}$ of approximately $3\times10^5$ and for iron(III) a $K_{f1}$, $K_{f2}$, $K_{f3}$ and $K_{f4}$ of 30, 134, 98 and 1.0, respectively. The other solutions also have differential ligand formation constants for hydroxide, ammonia, water, hydrogen peroxide and sulfate. If the iron is present as a fluoride complex or as a chloride complex or as a hydroxide this will change the fundamental chemistry of the interactions in the baths as the reactions are equilibrium that will be controlled by the solution ligands and the reaction products. By adding the isotopic spikes for iron, for example, in a plus three oxidation state, species in a very weak ligand, such as a nitrate, the ligand of the spike will be dynamically transformed into the species that is dominant in the solution and subsequently will equilibrate dynamically on-line or in-process with the elemental species contaminant in the cleaning bath or chemical process. If a chemical reaction occurs in a process, for example, in wafer cleaning, a reaction with the silica matrix and masking reagents may occur and it may create a different species, Fe(II) or Fe(III) or Fe-organometalic or a stable ligand species it may also be present in solution and a different ligand species will be evident in the speciated mass spectral examination. This is an additional informational adjustment over previous methods that extends the chemical information beyond elemental species contamination and adds the dimension of chemical specificity to the in-process chemistry. In addition, if a contaminant originates in a solution such as the HF bath and then is measured in the sulfate bath or water bath it will very likely retain its ligand of origin permitting the identification of the contamination source. This data is an addition to the complex information that will be obtained employing this method.

In another embodiment a strong chelating or complexing reagent will be added to both the sample and the spike and the quantitative measurement will be made as the complex. This chemical transformation of the species controls the chemistry of the solution and enhances the measurement and enables control of chemistry parameters that may otherwise be detrimental to the detection of the analytes of interest.

As shown in FIG. 2, a sample from one or a plurality of baths is provided to the system at sample introduction 2. A portion of the sample (the singular will be used as a convenient means referring to one or a plurality of baths as the source of the same depending upon whether the samples are taken and processed individually on a bath-by-bath basis or simultaneously and co-mingled) will be introduced into the sample analysis stage 6 wherein determinations will be made regarding whether the sample is at the desired pH level, has the adequate amount of reagent, and the desired physical and/or chemical properties, such as temperature. This information is introduced into the microprocessor 10 indicated by the dashed line for handling in a manner to be discussed hereinafter.

As the present system is adapted to provide unattended, automated determination of specie identification, qualitatively and quantitatively, or elemental identification, qualitatively and quantitatively, three methods may be employed within the present system.

If it is desired to determine, qualitatively, the presence of a specie, the sample from sample introduction is introduced into the chemical modification step 12, wherein information provided from sample analysis 6 to microprocessor 10 will have entered data collection and analysis 14, which, in turn, distributes the information 16 which is passed onto controller 20, which, in turn, provides an output signal along lead 24 to chemical modification 12 to provide whatever adjustment in the chemistry, such as pH or reagent content, or physical properties, such as temperature, to the sample prior to the next stage of sample processing. The sample, as modified, is then delivered to the solution-handling unit which if the objective is qualitative, evaluation of the sample will deliver the same to atmospheric pressure ionization unit 32 which, in a preferred form, is an electrospray ionizer. This unit serves to ionize the components of the solution including the elements and species and, if desired, de-solvates the sample. The output of this unit is delivered to mass spectrometer 36, which may preferably be a time of flight mass spectrometer, or quadrapole mass spectrometer. The information from the mass spectrometer is delivered to the microprocessor 10 into the data collection and analysis unit 14, which, in turn, delivers it for information distribution to unit 16. Information which is to be employed in controlling operation of the instrument will be fed back to a sample introduction 2, spike introduction 38, chemical modification 12, solution handling 26, atmospheric pressure ionization 32, and mass spectrometer 36 for appropriate action. Further, to the extent to which the information may involve a departure from a desired concentration of contaminants, if an early warning is to be provided or an alert or shutdown ordered, the information is also delivered to the system interface 40 which controls the operation of the physical system which is being monitored by the instrument. This information may also be provided to operational personnel who would be provided with not only the warning and alert information, but also data regarding the then current readings, long-term trends, and other information of interest, including optimization information. Considering another mode of operation of the method, if it is desired to obtain quantitative determinations of an element, the sample introduction 2 delivers a sample to the spike introduction location, wherein enriched separated isotopes are mixed in dilute or a weakly complexing mode where they are mixed with the sample and subjected to equilibration. The equilibrated sample is then passed through chemical modification 12 and solution handling 26 from which it goes to liquid chromatograph 48 and then to atmospheric pressure ionization 32, after which, it is subjected to speciation processing 56 from which it passes to mass spectrometer 36 with the output of the mass spectrometer being processed in microprocessor 10 and, as appropriate, passed on to controller 12 and/or system interface 40. For the elemental mode, the voltage ranges from about 200 to 1,000 volts and preferably about 350–400 volts and for the specie mode from about 2–30 volts. In this approach, an enriched isotope is provided in the spike introduction 38 for each specie or element of contaminant sought to be monitored. If the sample were a gas sample, it would pass from solution handling 26 to gas chromatograph 56 and follow the process.

Where quantitative element determination is to be made, the output of atmospheric pressure ionization 32 is delivered to processing by elemental mode 60 from which the process sample enters the mass spectrometer.

Figure 3:
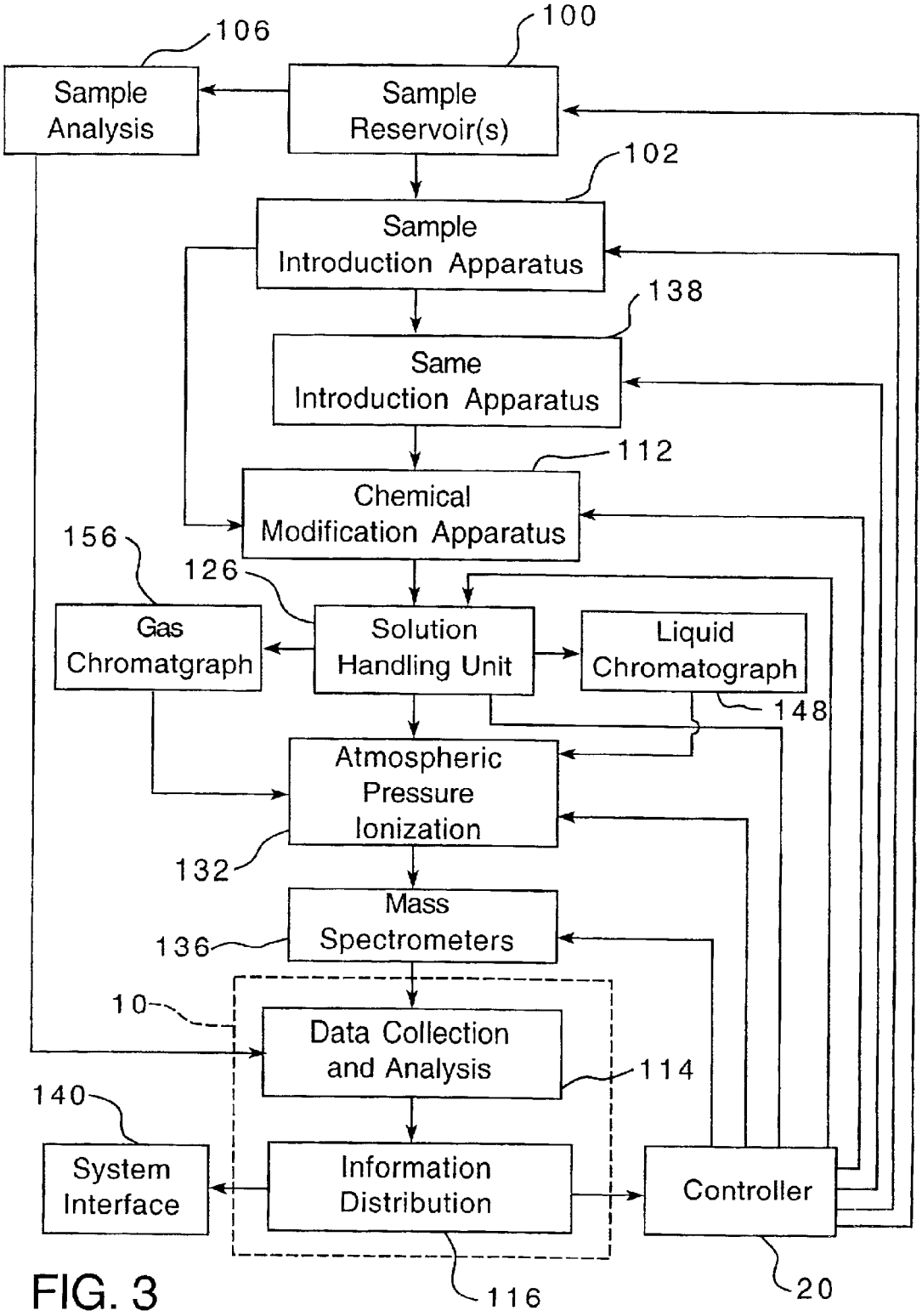
FIG. 3 is a schematic diagram illustrating a form of apparatus of the present invention.

Referring to FIG. 3, there is shown a form of apparatus usable in the method of the present invention with specific reference to a preferred method as illustrated and described in connection with FIG. 2. One or more sample reservoirs 100 provide a portion of the sample to the sample introduction apparatus 102. The samples may be introduced sequentially for independent processing or, if desired, by introduced simultaneously for co-mingled processing. A portion of the sample may be delivered to sample analyzer 106 which determines certain chemical and physical characteristics, such as, for example, pH, reagent concentration and temperature which, in turn, delivers the output to microprocessor 10. The microprocessor, in turn, has the data collection and analysis unit therewithin 114 process the same and deliver to information distribution unit 116 from which the information may be passed to controller 20 with appropriate feedback as needed to the chemical modification apparatus 112 in order to effect adjustment of the chemical and physical characteristics of the sample where needed. The sample introduction apparatus 102 cooperates with both the chemical modification apparatus 112 and the spike introduction apparatus 138 in a manner hereinbefore described. The output of the chemical modification apparatus is delivered to the solution handling unit 126 which, in turn, depending upon whether fluid being processed is liquid or gas, will respectively deliver the sample to gas chromatograph 156 or liquid chromatograph 148 from either of which the sample is delivered to atmospheric ion generator 132 with the output thereof being delivered to mass spectrometer 136 for processing.

Figure 4:
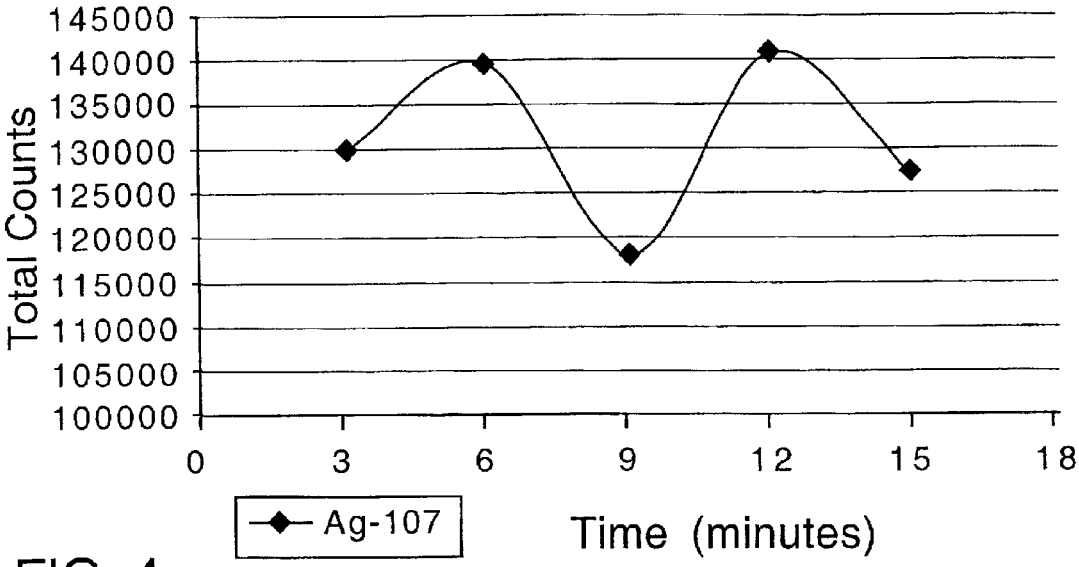
FIG. 4 is a plot of total counts versus time illustrative of mass spectrometer drift.
Figure 5:
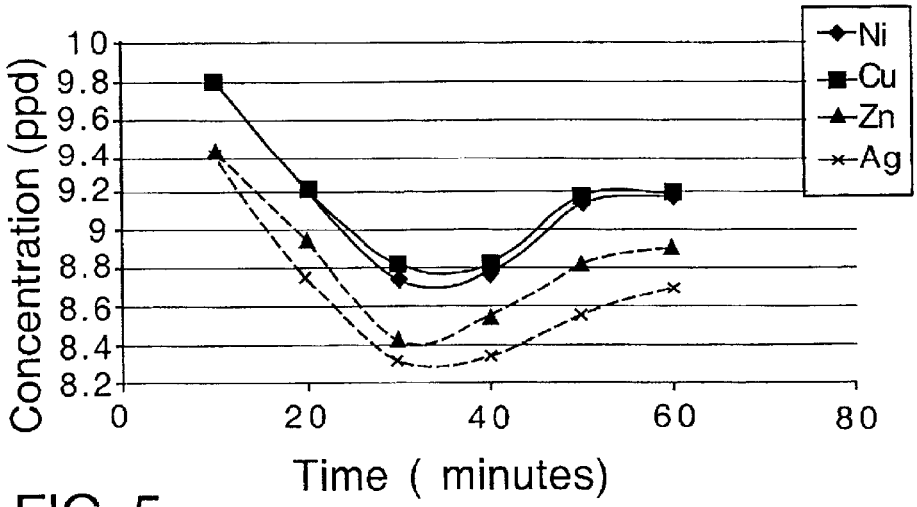
FIG. 5 is a plot of concentration in parts per billion versus time also illustrative of mass spectrometer drift.

Ordinarily, a mass spectrometer will drift and become unstable with time, as demonstrated in the two examples provided here in FIGS. 4 and 5. In these examples, an Electrospray Mass Spectrometer (ES-MS) and an Inductively Coupled Plasma Mass Spectrometer (ICP-MS) demonstrate normal instability with time. In both cases quantitative capability varies and is degraded over relatively short periods of time. It is further demonstrated that relying on isotopic ratio measurements normalized these instabilities and restored relative quantitative capability. Using isotopic ratio measurements the automated unattended operation in a stream of process fluids is enabled. The sequential analysis of multiple fluids of different physical and chemical composition is also enabled. When changes in fluid composition normally require manual calibration and re-calibration steps, these steps are eliminated by relying not on calibration, but on direct isotopic ratio evaluation.

FIG. 4 shows the Ag-107 signal response drift in API (ES)-MS over 15 minutes. 1 ppm Ag in 1% $HNO_3$ was introduced to an ES-MS instrument. Five replicate measurements were performed. The counts for isotope 107 give as large as 25% drift of ES-MS response, which is typical over the measurement period.

FIG. 5 shows actual measurements of the ICP-MS data with time. A sample containing 10 ppb Ni, Cu, Zn, and Ag (Nickel, Copper, Zinc and Silver) was continuously introduced into ICP-MS and the data was collected in six 10-minute intervals. The conventional calibration (an introduction of known standards producing a calibration curve) for these 4 elements was performed at the beginning of the experiment. The integrated results for each 10-minute period were compared to the calibration curves and the results are illustrated. This figure shows the trend of the ICP-MS response drift in 60 minutes for Ni, Cu, Zn and Ag. For example, the response of Ag down drifts approximately 17%, from 10 ppb to 8.3 ppb in 30 minutes; then up drifts to 8.7 ppb in next 30 minutes. This drift with the same solution illustrates a mass spectrometer's tendency to drift. Solution changes such as viscosity, composition and other differences alter the signal output and these further changes in addition to the instrument drift.

Figure 6:
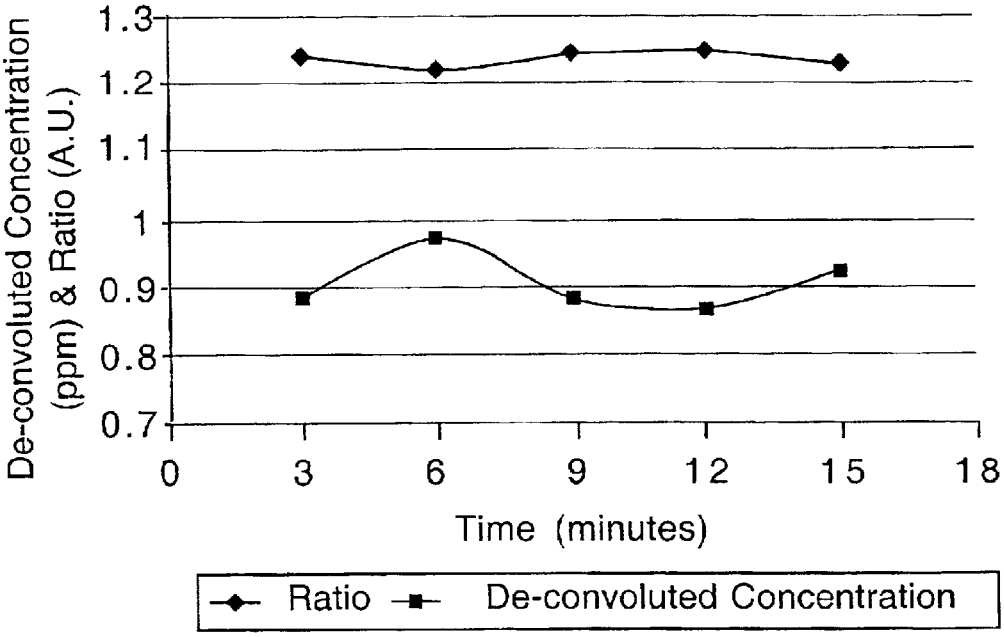
FIG. 6 are plots of de-convoluted concentration and ratio versus time.
Figure 7:
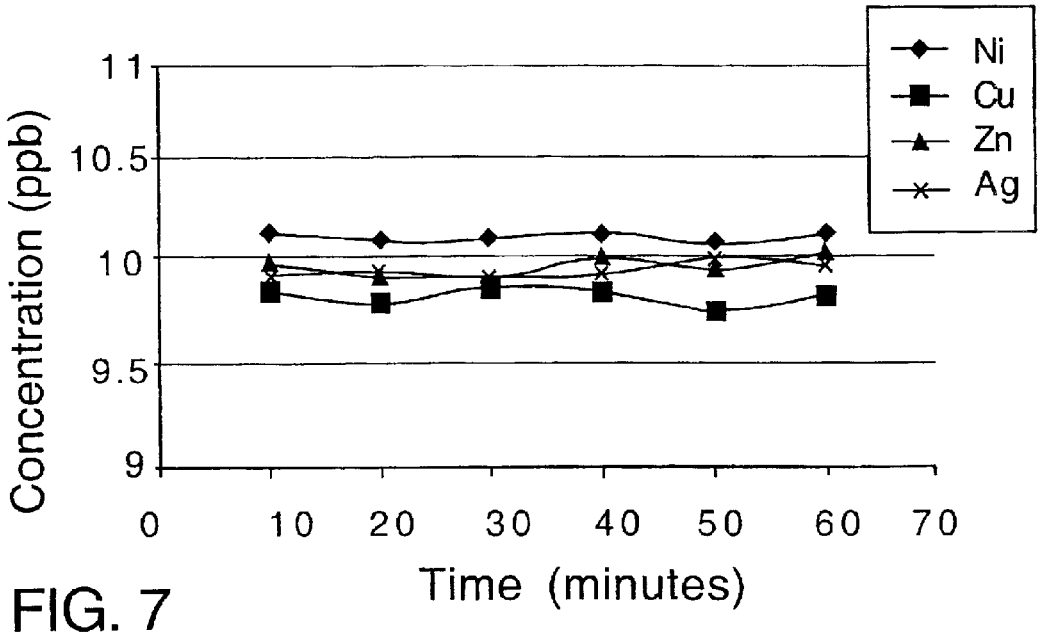
FIG. 7 is a plot of concentration versus time.
Figure 8:
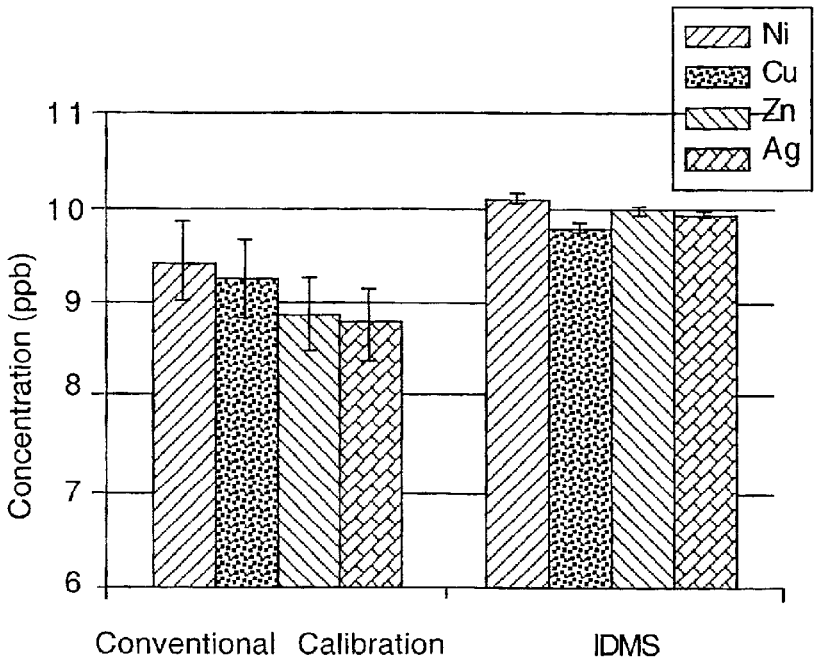
FIG. 8 shows bar graphs of concentration versus conventional calibration and IDMS.

FIGS. 6, 7, and 8 demonstrate the capability of the present invention to maintain quantitative mass spectral capability for unattended automated in-process analysis on these two instruments and demonstrate the effectiveness of this method and the apparatus necessary to accomplish this method. Successive measurements of the fluids used in the semiconductor cleaning process described in Table 1 would normally require re-calibration for each successive sample. The undesired instrument drift as demonstrated also requires frequent calibration and prevents instruments operated in classical calibration fashion from operating in an automated and unattended manner. These repeated classical calibration steps are eliminated using the present invention, and direct unattended automated in-process analysis is enabled. The present invention is, for simplicity of disclosure disclosed with respect to two instruments, specifically an API(ES)-MS and an ICP-MS.

FIG. 6 shows the ratio and de-convoluted result for Ag measured by ID API (ES)-MS. A 1 ppm Ag in 1% $HNO_3$ was spiked with Ag-109 quantitatively. Five replicate measurements were performed under the same instrument conditions. The counts of isotope Ag-107 and Ag-109 were extracted and the ratio of 109/Ag-107 was calculated. The measured ratio of 109/Ag-107 was 1.2303±0.016 (1.3% variance which shows as the top line in the figure). The sample concentration was de-convoluted based on the measured ratio, and final result was 0.904±0.05 ppm (5.5% variance, which shows as bottom line in the Figure). By comparison with FIG. 4 which shows an approximate 25% variance there is a significant improvement in precision over the test period of 15 min. in this case. This demonstrates the ability of the invention to improve the precision of the measurement for ES-MS.

FIG. 7 shows the de-convoluted results by applying the concept of the invention to an ICP-MS instrument for a 60 minute measurement. A sample containing 10 ppb Ni, Cu, Zn, and Ag (Nickel, Copper, Zinc and Silver) was spiked with a known amount of enriched isotopes of Ni-62, Cu-65, Zn-68, and Ag-109. The spiked sample was continuously introduced into the ICP-MS and the data was again collected in six 10-minute periods. The integrated result for each 10-minute period was extracted and isotopic ratios of Ni 62/60, Cu 65/63, Zn 68/63 and Ag 109/107 was calculated. The de-convoluted concentrations were calculated and the results are illustrated in the figure. For example, the final result for Ag is 9.94±0.03 ppb. This is much more accurate and precise measurement than was achieved when traditional calibration was relied upon over an extended period of time. A further comparison of this implementation of the invention with conventional calibration for all four elements Ni, Cu, Zn, Ag is shown in more detail in FIG. 8.

FIG. 8 illustrates the comparison of the conventional calibration (illustrated in FIG. 5) and the invention concept that is implemented on an ICP-MS instrument in this example (illustrated in FIG. 7). The four left columns in FIG. 8 are the results obtained from the conventional calibration, which are 9.1±0.4, 9.2±0.4, 8.8±0.4, 8.7±0.4 ppb for Ni, Cu, Zn and Ag, respectively. The four right columns are the results obtained by applying the invention concept to the IDMS measurement. When applied, the results are 10.11±0.03, 9.81±0.05, 9.97 ±0.05, 9.94±0.03 ppb for Ni, Cu, Zn and Ag, respectively. These results demonstrate a clear improvement in both precision and accuracy. These results are more accurate and precise than conventional calibration over the 60 minute period tested.

Consistent improvement in both precision and accuracy in multiple mass spectrometers with a variety of ionization interfaces demonstrate the general applicability of the invention to enable the mass spectrometer system to function for extended periods of time and to reduce the error caused by instrument drift and conventional calibrations.

It is clear that IDMS analysis is at least an order magnitude more accurate and precise than conventional calibration over a period of 60 minutes.

TABLE 1

Table 1 shows typical silicon wafer cleaning solutions and reagents employed in the semiconductor industry.*

| Solution Name | Chemical Composition | Typical Formulations | Purpose of Cleaning |
|---|---|---|---|
| 1. Ultra-Pure Water "UPW" | $H_2O$ Ultra-Pure | 100% | Primary Dilution Reagent |
| 2. SC-1, RCA-1 "Huang 1" | $NH_4OH:H_2O_2$; $H_2O$ | 1:1:5, 75° C. | Organic Removal MetaI Ion Complexing |
| 3. SC-2, RCA-2, "Huang 2" | $HCl:H_2O_2:H_2O$ | 1:1:6, 80° C. | Alkali Ion Removal Metal Hydroxides Dissolution, Residual Trace Metal Removal |
| 3. SC-2, RCA-2, "Huang 2" | $HCl:H_2O_2:H_2O$ | 1:1:6, 80° C. | Alkali Ion Removal Metal Hydroxides Dissolution, Residual Trace Metal Removal |
| 4. Mixture of Sulfuric Peroxide, SPM "Piranha" | $H_2SO_4:H_2O_2$ | 2:1, 90° C. | Organic Removal |
| 5. Diluted HF | $HF:H_2O$ | 1:10–100, 25° C. | Native Oxide Removal |

*(as modified in accordance with Kern W., "Handbook of Semiconductor Wafer Cleaning Technology: Science, Technology and Applications", Noyes Publications, 1993).

The method and apparatus goals are to provide close to real-time analytical chemical metrology of contaminant concentrations in these solutions. Generally, the contaminants of primary interest may include at least one element selected from the group consisting of Ca, Co, Cr, Cu, Fe, Mn, Mo, Ni, W, Na, P, B, As, Sb, and Zn, but it is desirable to measure any additional elements present at significant concentrations. The concentration range that must be assessed is mid-ppb to low-ppt and continually will drop as the instrument detection limits are gradually reduced. Thus the character of the measurement will remain the same and will require the optimization of ultra trace measurements progressing but using the same fundamental theoretical considerations. The technology is a critical quality control assessment tool for uses such as in wet process baths in the semiconductor industry as in chip manufacturing activities. As circuitry on wafers continues to shrink, these contaminants will have even greater impact on the viability of the final products.

The use of the methods of the present invention at or near the detection limits of the mass spectrometer involves modification of the ratio measurement. When elemental and species components are at concentrations in the fluids well above the detection limits of the mass spectrometer, the use of commercially available isotopes is possible. When these measurements are required at the threshold of detection of the instrument, uncertainties can make the analysis more difficult. In these cases, enhancing the certainty of the detection limit measurement is desirable. The isotopic ratio can be altered in the spiking fluids to optimize the ratio measurement at these levels. An example of how these specially prepared spikes enhance these measurements follows. An optimum ratio at and near the limit of detection is more difficult than measurements at nominally normal or high concentrations. Establishing a ratio that definitively establishes the threshold of detection and enables the uncertainty of the measurement to be known and optimized for the IP/MS is a unique optimization at the detection limit threshold. The optimization of the ratio for detection limit and near detection limit is achieved by using matched quantities of spike optimized for the threshold level and /or mixing both natural and multiple enriched isotopes in separated quantities of the same element. This technique is not present in traditional IDMS methods where this measurement is uncertain over a wide range.

The measurement of elemental contamination at or near the quantitative detection limit of this instrument will progress as the instrument detection limit recedes in future instruments. Because of the needs of many industries, such as the semiconductor industry, for example, the level of elemental contamination will continue to decrease. As the instrumental measurement sensitivity also decreases the need to measure and make accurate measurements at the detection limit of the mass spectrometer will remain in relatively similar relationships. These concepts are durable detection limit threshold measurement optimizations that will progress with detection limit of the instrument and retain their useful attributes as both the need, and capability recede simultaneously.

Figure 9:
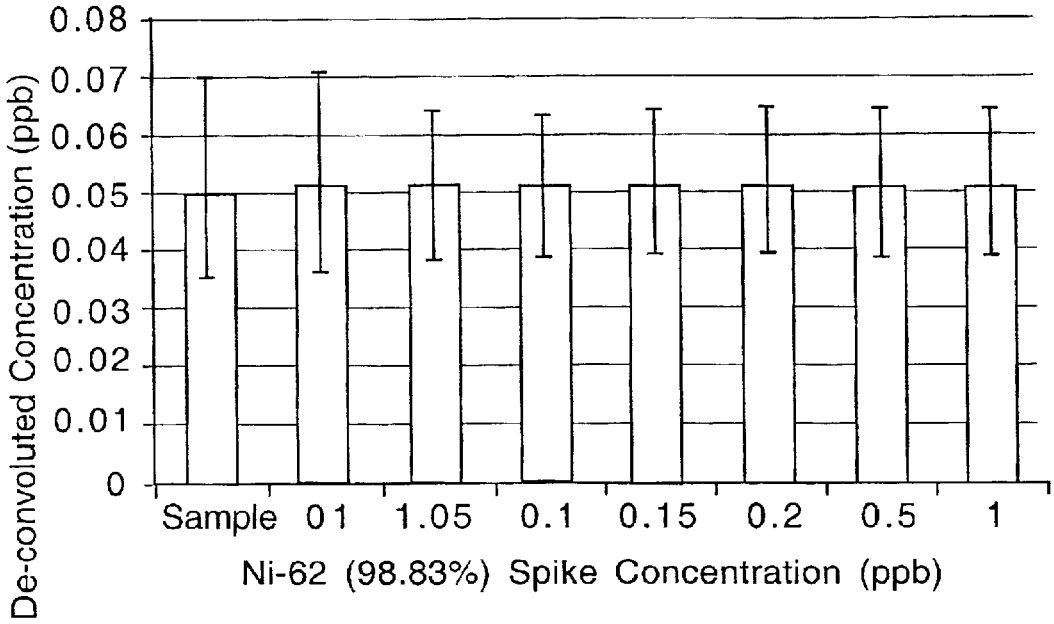
FIG. 9 is a plot of de-convoluted concentration versus spiked concentration for several samples.
Figure 10:
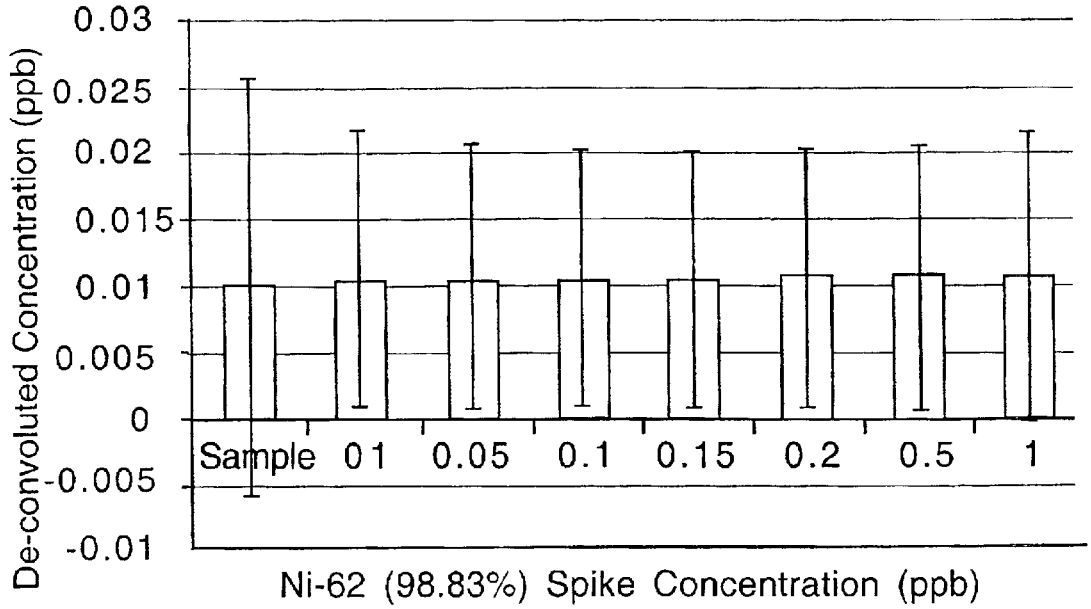
FIG. 10 is a plot of de-convoluted concentration versus spiked concentration.

In order to provide additional insight into the system of the present invention, computer model studies were undertaken with the results being shown in FIGS. 9 and 10.

FIG. 9 represents the threshold measurement for 0.05 ppb Ni at the instrument quantitative detection limit. The first evaluation (left most evaluation) demonstrates the quantitative measurement at the instrument quantitative detection limit (0.05 ppb) using traditional calibration curve procedures. In this case, the instrument quantitative detection limit is defined as 10 times that of the standard deviation of the instrument signal, which is equal to the square root of the signal. The uncertainty of this traditional measurement is expressed as 3 times of standard deviation of such a measurement. Monte Carlo simulation is used to demonstrate the establishment of threshold using the novel method. In this approach, 200 sets of normally distributed numbers having a mean value of 0 and a standard deviation of 1 are applied to the simulation for each spike. The ratio of sample volume to spike volume is 1:1. The uncertainties of de-convoluted concentrations are expressed as 90% confidence level of 200 simulations for each spike. The simulation results are shown in the remaining columns in FIG. 9. These simulation results demonstrate the applicability and measurement improvement using the threshold isotope dilution method of the present invention to improve the threshold measurements at the instrument quantitative detection limit.

There is a window of optimum spike concentration from 0.05 ppb to 0.2 ppb (third through sixth column) which enables a preferred quantitative measurement of the 0.05 ppb Ni in the sample with improved precision as compared with the traditional calibration method (first column from the left). The trend demonstrates an optimum spiking ratio range that can be established experimentally and/or theoretically. This optimum range may preferably be used in quantification employing the method.

In FIG. 9, the measurement may be made by either convention calibration or isotope dilution mass spectrometry with better precision being demonstrated using IDMS spectrometry. The use of the present invention near the detection limit improves the precision of the quantitative determination.

FIG. 10 demonstrates the capability of using the threshold isotope dilution method of the present invention to evaluate the quantitative detection limit threshold of the instrument when the sample concentration is just below the instrument quantitative detection limit. In this case, the instrument was operated under the same conditions as those in FIG. 9. It is shown in the first column in the FIG. 10 that the quantitative measurement of the sample is not normally possible because the sample concentration (0.01 ppb) is below the instrument quantitative detection limit (0.05 ppb). In this way a measurement below the normal detection limit is made quantifiable. Ordinarily there would be a less than value established, but here a specific measurement is enabled. It is noted that a specific range of the amount of spike added enables the transformation of a less than value into a quantifiable value. This spike ratio is unique for each element and the optimum ratio is unique and experimentally or theoretically established for the spike solution that must be mixed to quantitatively evaluate the specific elemental group of analytes of interest. A trend is demonstrated that illustrates isotopic species concentrations for 0.01 to 0.5 ppb.

FIG. 10 demonstrates the capability of using the threshold isotope dilution method to evaluate the detection limit threshold when the sample concentration is just below the instrument detection limit. It is shown in the first column in the FIG. 10 that the quantitative measurement of the sample is not normally possible because the sample concentration (0.01 ppb) is below the instrument quantitative detection limit (0.05 ppb). However, by spiking with an optimum Ni-62 enriched isotope concentration (0.1 ppb, 98.83% enriched, {fourth measurement from the left}), a threshold measurement is established which is quantifiable at the 0.01 ppb level of Ni in the sample. In this way a measurement below the normal detection limit is made quantifiable. Ordinarily there would be a less than value established, but here a specific measurement is enabled. It is noted that a specific ratio is preferred and that this is a critical value that enables the transformation of a less than value into a quantifiable value. This spike ratio is unique for each element and the optimum ratio is unique and experimentally established for the spike solution that must be mixed to quantitatively evaluate the specific elemental group of analytes of interest.

In FIG. 10, the demonstration of threshold measurement for 0.01 ppb Ni below instrument quantitative detection limit is shown. The standard deviation of instrument signal is equal to the square root of the signal. The uncertainty of traditional measurement is expressed as 3 times of standard deviation of such measurement. Monte Carlo simulation is used to demonstrate the establishment of threshold using the novel method. 200 sets of normally distributed numbers having a mean value of 0 and a standard deviation of 1 are applied to the simulation for each spike. The ratio of sample volume to spike volume is 1:1. The uncertainties of de-convoluted concentrations are expressed as 90% confident level of 200 simulations for each spike.

Two types of information are available using different modes of operation of the IP-MS instrument. Quantification of the element in the fluid and species-specific information about the form of the element are important. The chemistry that is occurring in the process is described by both of these parameters. As both are desirable and must be used to describe the total chemistry of the process, both have been integrated into the method and apparatus.

Figure 11A:
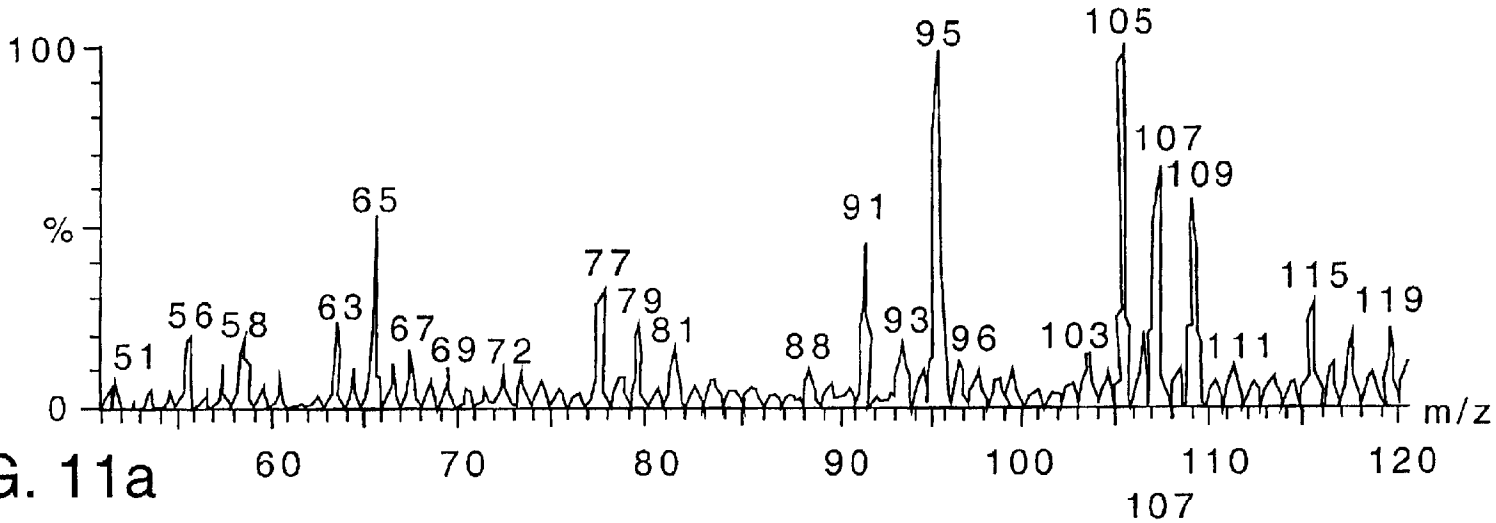
FIG. 11 shows a pair of mass spectra.
Figure 11B:
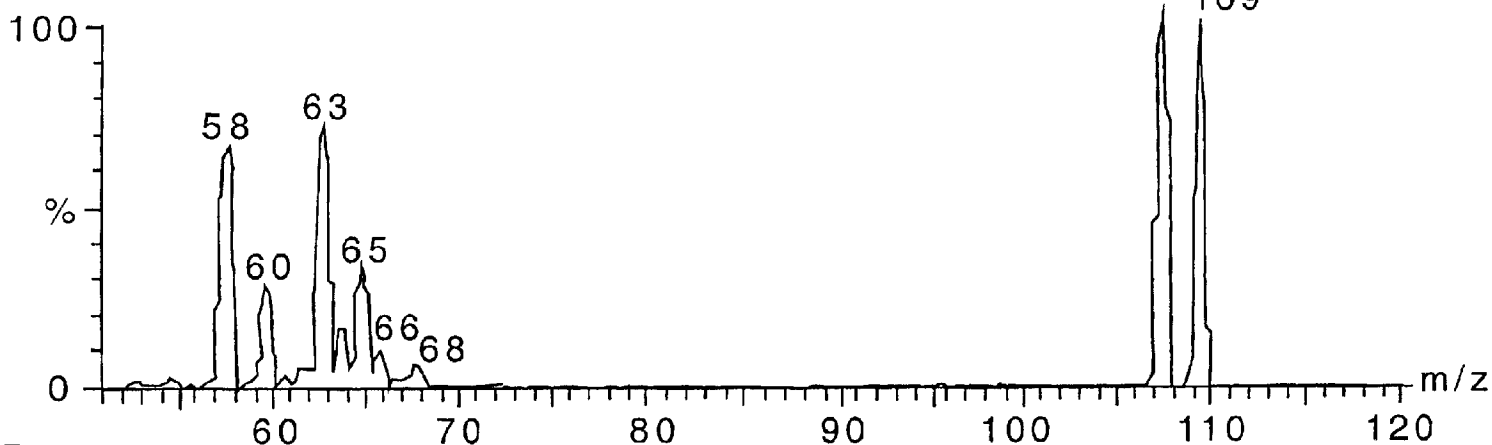

To obtain quantitative information about the element and for the purpose of determining the isotopic ratio, the species information within the fluid can be eliminated. This is accomplished by changing the instrument operational parameters to collision-induced disassociation (CID) mode. The CID can serve to simplify mass spectra, thereby reducing background and increasing sensitivity. For example, purposefully set the ionization voltage high enough to eliminate species information directly at the source of the mass spectrometer. Voltages of about 200 to 1000 volts on the sampling cone and on various components of the sampling system are used to eliminate the molecular information and to obtain relatively isolated elemental signals. FIG. 11 demonstrates the optimization of elemental information in this instrumental configuration. Molecular information may obscure the ratio measurements being used for quantification, and conditions are used that clarify and optimize the quantitative aspects of this measurement.

In FIG. 11 CID can simplify mass spectra, reduce the background and increase the sensitivity. The comparison of the element measurement using an ES-MS instrument under normal operation condition (cone voltage is 30 v) and CID condition (cone voltage is 300 v) is shown. The upper spectrum is the spectrum of 6 ppm mixed in a solution of Ni, Cu, Zn, Ag in 1% $HNO_3$ measured under the normal condition. The lower spectrum is the spectrum of the same solution measured under the CID condition.

The molecular species may be evaluated to determine elemental and molecular species occurring in solution. These evaluations are made on unaltered fluid streams and on isotopically labeled fluids. To make these measurements with the IP-MS, the API is operated in a non-species destructive manner, i.e. the instrument is operated under soft ionization conditions such as low cone voltage, slower cone gas flow, and mild de-solvation temperature. Elements that occur in complex ligand or molecularly bound forms are revealed in this operational mode. These complexes that indicate the chemistry occurring in the process are extremely valuable informational components used for qualitative evaluation, and to identify conditional trends and process alternatives.

To quantify these species and evaluate the chemistry, isotopically labeled species are created dynamically. The method and apparatus create the species occurring in the sample from the optimally prepared spike reagent solutions. These spike reagents (enriched isotope solutions) are optimized ratio-separated stable isotopes in a solution of non-complexing or non-ligand forming or weak ligand forming counter ions. Nitrates are good examples of very weak ligand forming counter ions. Nitrate ligand formation constants ($K_f$) are generally and uniformly several orders of magnitude smaller than fluoride complexes, and several orders weaker than chloride and sulfate ligands. When solutions of enriched isotopic spike are mixed with the sample reagent solutions (for example, listed in Table 1), the spike or isotope ion will conform to the solution species in the reagent solution. The contaminant concentration (in this example, but deliberate concentrations in other fluids) is very small in comparison to these relatively abundant solution components and will cause the formation of these species that are occurring in solution. The creation of spiked species and isotopic labeling is accomplished dynamically for the processing fluids of silicon wafer materials, for example. Mixing of the spike solutions with these fluids establishes the same species that are naturally occurring in these solutions and provides the ability to determine their concentrations in a similar manner using isotopic ratio measurements.

The combination of both the quantitative and qualitative measurements information available from the same instrument operated in different conditions is desirable and necessary for full understanding and evaluation of fluids described in these examples and in other examples. Both are capable from a single instrument as described.

The alteration of the fluid sample is also necessary for the optimization of both quantitative and qualitative measurement of some process fluids. This fluid processing may be accomplished in several ways. For example, the sample may be directly combined with a neutralizing agent for the adjustment of pH. Consider solutions from table 1, $NH_4OH$ (a base) and acids HF, HCl and $H_2SO_4$ may require neutralization or they may be combined to neutralize each other. Combining these samples with other solutions that have acid-base neutralization capabilities is part of fluid handling. Direct neutralization of an acid with a base, or base with an acid, is also part of the fluid handling system. In this latter case, a reagent, rather than another sample, becomes the neutralizing solution.

Other components of fluid handling are the collection and accumulation of metal ions on chelating, ion-exchange, and normal and reversed phase chromatography columns integrated into the fluid and sampling handling portions of the overall system. These manipulations may be undertaken to optimize the qualitative and quantitative measurement and evaluation of the solution.

Other components of the fluid handling system incorporate automated derivatisation and chemical enhancement of the signal through the addition of modifying agents such as ligands, chelators, surfactants, solvents, and/or other reagents that amplify the ionization and/or the signal in the mass spectrometer.

The fluid handling instrument component incorporates mixing, chemical modification, metering, dilution, preconcentration, and other aspects of fluid handling used in qualitative and quantitative manipulation of the fluid sample stream.

Appropriate software, which may be developed by those skilled in the art, will be employed in controlling operation of the method and apparatus and processing data obtained therefrom.

While for convenience of illustration emphasis has been placed herein on examples directed toward monitoring of contaminants in wet baths employed in clean rooms in the semiconductor industry, it will be appreciated that the invention is not so limited and, as will be apparent to those skilled in the art, numerous other applications, including in such uses as environmental, pharmaceutical, biotechnology, food processing, chemical manufacture, and production of reagents and standards, both preparation and certification will become apparent to those skilled in the art.

It will be appreciated, therefore, that the present invention provides a method and related apparatus for fully automated comprehensive analytical chemistry tools which can monitor on-line in-process solutions in an accurate and rapid manner for contaminants and thereby enhance the efficiency of manufacture.

Whereas particular embodiments have been described herein for purposes of illustration it will be evident to those skilled in the art that numerous variations of the details may be made without departing from the invention as defined in the appended claims.

What is claimed is:

1. A method of in-process ratio mass spectrometry comprising providing a sample, providing a spike related to said sample, spiking the sample with the spike and permitting equilibrium to occur therebetween, subjecting said equilibrated spike and sample to atmospheric pressure ionization to create ions therefrom, introducing said ions into a mass spectrometer for a ratio determination, and in a processor, using the ratio determination to characterize the sample.

2. The method of in-process ratio mass spectrometry of claim 1 wherein the act of providing a sample comprises providing a liquid sample.

3. The method of in-process ratio mass spectrometry of claim 2 wherein the act of providing a liquid sample comprises providing an aqueous sample.

4. The method of in-process ratio mass spectrometry of claim 1 wherein the act of providing a sample comprises providing a sample having one or more contaminants.

5. The method of in-process ratio mass spectrometry of claim 4 including detecting said contaminants at near instrument detection limits.

6. The method of in-process ratio mass spectrometry of claim 4 including detecting said contaminants at ultra-trace levels.

7. The method of in-process ratio mass spectrometry of claim 1 including after said equilibration but before said ionization, preconcentrating the spike and sample.

8. The method of in-process ratio mass spectrometry of claim 7 including effecting said preconcentration through liquid chromatography.

9. The method of in-process ratio mass spectrometry of claim 7 including separating at least one species of interest by said preconcentration.

10. The method of in-process ratio mass spectrometry of claim 1 comprising employing said method in qualitative analysis of an analyte in the sample.

11. The method of in-process ratio mass spectrometry of claim 1 further comprising employing said method in quantitative analysis of an analyte in the sample.

12. The method of in-process ratio mass spectrometry of claim 1 including employing information received by said processor to control operation of portions of said method.

13. The method of in-process ratio mass spectrometry of claim 1 further comprising obtaining said sample from a system being monitored, and delivering the information received by said processor regarding the characterization of the sample to said system from which the sample was obtained.

14. The method of in-process ratio mass spectrometry of claim 1 including employing said method to monitor concentration of analytes in semiconductor manufacture.

15. The method of in-process ratio mass spectrometry of claim 14 including employing said method sequentially on a plurality of wet baths used in the semiconductor manufacturing.

16. The method of in-process ratio mass spectrometry of claim 14 including employing said method simultaneously on a plurality of wet baths used in the semiconductor manufacturing.

17. The method of in-process ratio mass spectrometry of claim 1 wherein the act of providing the sample comprises providing a gaseous sample.

18. The method of in-process ratio mass spectrometry of claim 1 including employing electrospray ionization as said atmospheric pressure ionization.

19. The method of in-process ratio mass spectrometry of claim 14 including employing said method to determine the origin of the analytes.

20. A method of automated isotope dilution mass spectrometry comprising providing a sample to be analyzed, spiking at least one enriched stable isotope of an element or specie related to said sample, introducing said spiked enriched stable isotope elements or species into said sample and permitting equilibrium to occur therebetween, subjecting said equilibrated spikes and sample to atmospheric pressure ionization to create ions therefrom, introducing said ions into a mass spectrometer for isotopic ratio determination, delivering information from said determination to a microprocessor, and in effecting said equilibrium equilibrating at least one said spiked enriched stable isotopic specie or element dynamically with a specie or element contained within the sample.

21. Apparatus for in-process ratio mass spectrometry comprising sample receiving apparatus adapted to receive a sample, spike introduction apparatus for introducing at least one spike into said sample for permitting equilibration therebetween, an atmospheric pressure ionizer for receiving said equilibrated sample and spike and ionizing the same, a mass spectrometer for receiving and processing said ions by ratio determination, and a processor adapted to use the ratio to characterize the sample.

22. The in-process ratio mass spectometry apparatus of claim 21 further comprising a sample analyzer for analyzing said sample and delivering sample analysis information to said processor.

23. The in-process ratio mass spectrometry apparatus of claim 22 futher comprising a controller for receiving information processed by said processor and providing feedback to other portions of said apparatus.

24. The in-process ratio mass spectrometry apparatus of claim 21 further comprising a controller for receiving information processed by said processor and providing feedback to other portions of said apparatus, and sample modification apparatus for altering characteristics of said sample responsive to signals from said controller prior to the sample entering said atmospheric pressure ionizer.

25. The in-process ratio mass spectrometry apparatus of claim 24 wherein said controller is configured to coordinate operation of said sample receiving apparatus, said spike introduction apparatus, said sample modification apparatus, said atmospheric ion generator and said mass spectrometer.

26. The in-process ratio mass spectrometry apparatus of claim 25 further comprising solution handling apparatus interposed between said sample modification apparatus and said atmospheric ion generator, and at least one chromatograph operatively associated with said solution handling unit for preconcentrating said equilibrated sample and spike prior to delivery to said atmospheric ion generator.

27. The in-process ratio mass spectrometry apparatus of claim 26 wherein said chromatograph is selected from the group consisting of a liquid chromatograph and a gas chromatograph.

28. The in-process ratio mass spectrometry apparatus of claim 26 wherein said sample receiving apparatus includes a first outlet conduit in communication with said spike introduction apparatus which in turn has an outlet conduit in communication with said sample modification apparatus and a second conduit in communication with said sample modification apparatus.

29. The in-process ratio mass spectrometry apparatus of claim 21 wherein said atmospheric ion generator is an electrospray ionizer.

30. The in-process ratio mass spectrometry apparatus of claim 21 wherein said atmospheric ion generator is structured to operate at a first voltage when the apparatus is characterizing an element in the sample and a lower second voltage when when the apparatus is characterizing a species in the sample.

31. The in-process ratio mass spectrometry apparatus of claim 30 wherein said first voltage is 200 to 1,000 volts and said second voltage is 2 to 30 volts.

32. The in-process ratio mass spectrometry apparatus of claim 21 further comprising a system interface for receiving information from said processor and providing feedback to the system being monitored.

33. The in-process ratio mass spectrometry apparatus of claim 32 wherein said system interface includes a warning capability if the concentration of a monitored contaminant approaches a tolerable limit thereof and an alarm capability if the concentration of said contaminant violates the tolerable limit.

34. The in-process ratio mass spectrometry apparatus of claim 21 wherein said atmospheric ion generator is an atmospheric pressure chemical ionizer.

35. A method of in-process ratio mass spectrometry comprising providing a sample having an analyte, providing a spike related to the analyte, spiking the sample with the spike and permitting equilibrium to occur therebetween, in effecting the equilibrium between the spike and the sample, dynamically transforming the analyte and the spike to the same species, subjecting the equilibrated spike and sample to atmospheric pressure ionization to create ions therefrom, introducing said ions into a mass spectrometer such that the mass spectrometer forms a ratio response, and in a processor, using the ratio to characterize the analyte in the sample.

36. The method of in-process ratio mass spectrometry of claim 35, wherein the dynamic transformation of the analyte and the spike to the same species comprises dynamically transforming the spike to the same species as the analyte.

37. A method of in-process ratio mass spectrometry, comprising analyzing a first sample from a source having an analyte;

providing a second sample from the source;

providing a spike related to the analyte, the spike having a concentration based upon the analysis of the first sample;

spiking the second sample with the spike and permitting equilibrium to occur therebetween, subjecting the equilibrated spike and seond sample to atmospheric pressure ionization to create ions therefrom, introducing said ions into a mass spectrometer for a ratio determination, and in a processor, using the ratio determination to characterize the second sample.

* * * * *

UNITED STATES PATENT AND TRADEMARK OFFICE

CERTIFICATE OF CORRECTION

PATENT NO. : 6,974,951 B1
APPLICATION NO. : 10/004627
DATED : December 13, 2005
INVENTOR(S) : Kingston et al.

It is certified that error appears in the above-identified patent and that said Letters Patent is hereby corrected as shown below:

On the Title page Item (75) please add inventors: Marc R. Anderson, Sunnyvale, CA (US) and Ye Han, San Jose, CA (US)

On the Title page Item (12) please delete "Kingston" and insert --Kingston et. al.--

Signed and Sealed this

Fourth Day of March, 2008

JON W. DUDAS
*Director of the United States Patent and Trademark Office*